US011391424B2

(12) United States Patent
Chen et al.

(10) Patent No.: US 11,391,424 B2
(45) Date of Patent: Jul. 19, 2022

(54) LIGHTING APPARATUS

(71) Applicant: XIAMEN ECO LIGHTING CO. LTD., Xiamen (CN)

(72) Inventors: Xiaobin Chen, Xiamen (CN); Chunteng Chen, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 13 days.

(21) Appl. No.: 16/816,190

(22) Filed: Mar. 11, 2020

(65) Prior Publication Data

US 2020/0340633 A1 Oct. 29, 2020

(30) Foreign Application Priority Data

Apr. 24, 2019 (CN) ..... 201920569972.0

(51) Int. Cl.
*F21S 8/06* (2006.01)
*F21V 21/30* (2006.01)
*F21S 4/26* (2016.01)

(52) U.S. Cl.
CPC ..... *F21S 8/061* (2013.01); *F21S 4/26* (2016.01); *F21V 21/30* (2013.01)

(58) Field of Classification Search
CPC ..... F21S 4/20–28; F21S 8/06–068; F21V 7/00–18; F21V 14/04; F21V 21/30; F21Y 2103/10; F21Y 2115/10
USPC ..... 362/217.05, 223, 433
See application file for complete search history.

(56) References Cited

U.S. PATENT DOCUMENTS 6,382,817 B1 * 5/2002 Chelf ..... F21V 17/02 362/322
7,080,927 B2 * 7/2006 Feuerborn ..... F21S 2/005 362/238
7,677,764 B2 * 3/2010 Lin ..... F21V 14/04 362/283
9,546,761 B2 * 1/2017 Kim ..... F21K 9/61

* cited by examiner

*Primary Examiner* — Jason M Han
(74) *Attorney, Agent, or Firm* — Chun-Ming Shih; Lanway IPR Services

(57) ABSTRACT

A lighting apparatus has an elongated light source, a main housing, and a lateral wing. The main housing has a main body and a light passing cover. The elongated light source is attached to the main body. A light of the elongated light source passes through the light passing cover. The first lateral wing is detachably attached to an external side wall of the main body. A portion of the light passing through the light passing cover is further reflected by an inner surface of the lateral wing.

17 Claims, 12 Drawing Sheets

LIGHTING APPARATUS

FIELD

The present invention is related to a lighting apparatus and more particularly related to a light apparatus with an elongated light source.

BACKGROUND

Lighting or illumination is the deliberate use of light to achieve a practical or aesthetic effect. Lighting includes the use of both artificial light sources like lamps and light fixtures, as well as natural illumination by capturing daylight. Daylighting (using windows, skylights, or light shelves) is sometimes used as the main source of light during daytime in buildings. This can save energy in place of using artificial lighting, which represents a major component of energy consumption in buildings. Proper lighting can enhance task performance, improve the appearance of an area, or have positive psychological effects on occupants.

Indoor lighting is usually accomplished using light fixtures and is a key part of interior design. Lighting can also be an intrinsic component of landscape projects.

A light-emitting diode (LED) is a semiconductor light source that emits light when current flows through it. Electrons in the semiconductor recombine with electron holes, releasing energy in the form of photons. This effect is called electroluminescence. The color of the light (corresponding to the energy of the photons) is determined by the energy required for electrons to cross the band gap of the semiconductor. White light is obtained by using multiple semiconductors or a layer of light-emitting phosphor on the semiconductor device.

Appearing as practical electronic components in 1962, the earliest LEDs emitted low-intensity infrared light. Infrared LEDs are used in remote-control circuits, such as those used with a wide variety of consumer electronics. The first visible-light LEDs were of low intensity and limited to red. Modern LEDs are available across the visible, ultraviolet, and infrared wavelengths, with high light output.

Early LEDs were often used as indicator lamps, replacing small incandescent bulbs, and in seven-segment displays. Recent developments have produced white-light LEDs suitable for room lighting. LEDs have led to new displays and sensors, while their high switching rates are useful in advanced communications technology.

LEDs have many advantages over incandescent light sources, including lower energy consumption, longer lifetime, improved physical robustness, smaller size, and faster switching. Light-emitting diodes are used in applications as diverse as aviation lighting, automotive headlamps, advertising, general lighting, traffic signals, camera flashes, lighted wallpaper and medical devices.

Unlike a laser, the color of light emitted from an LED is neither coherent nor monochromatic, but the spectrum is narrow with respect to human vision, and functionally monochromatic.

The energy efficiency of electric lighting has increased radically since the first demonstration of arc lamps and the incandescent light bulb of the 19th century. Modern electric light sources come in a profusion of types and sizes adapted to many applications. Most modern electric lighting is powered by centrally generated electric power, but lighting may also be powered by mobile or standby electric generators or battery systems. Battery-powered light is often reserved for when and where stationary lights fail, often in the form of flashlights, electric lanterns, and in vehicles.

Although lighting devices are widely used, there are still lots of opportunity and benefit to improve the lighting devices to provide more convenient, low cost, reliable and beautiful lighting devices for enhancing human life.

SUMMARY

In an embodiment, a lighting apparatus includes an elongated light source, a main housing and a first lateral wing.

The main housing has a main body and a light passing cover. The elongated light source is attached to the main body. For example, the main housing is a tubular housing with a guiding track for inserting a light source plate mounted with LED modules to slide in the guiding track. A light passing cover may be made together with the main body with a plastic material. The main body may have a first color while the light passing cover has a second color. Specifically, the main body may have the color which light does not pas through. Therefore, people would not see the components concealed in the main body. On the other hand, the light passing cover may have a second color, e.g. to allow light passing through. The light passing cover may have a diffusion layer so that light passing through the light passing cover is diffused to be softened. In some other embodiments, the light passing cover may contain or integrated with lens structure for guiding light of the elongated light source to form a light beam or to change a main light path of the elongated light source.

The first lateral wing is detachably attached to an external side wall of the main body. A portion of the light passing through the light passing cover further being reflected by an inner surface of the lateral wing. For example, the inner surface of the first lateral wing may be disposed with white color or any reflective layer suitable for reflecting light emitted on the inner surface of the first lateral wing.

In some embodiments, the lighting apparatus may have a second lateral wing. The first lateral wing and the second lateral wing are disposed on opposite sides of the main body.

In some embodiments, the first wing has a first tilt angle with respect to the main body and the second wing has a second tilt angle with respect to the main body. The first tilt angle and the second tilt angle are different.

In some embodiments, the first lateral wing is detachable and taken away from the main body.

In some embodiments, a first end of the first lateral wing is connected to the main body and a second end of the first lateral wing is connected to another lighting apparatus.

In some embodiments, a first end of the first lateral is connected to the main body and a second end opposite to the first end has an inwardly curve.

In some embodiments, there are multiple tilt angles of the first lateral wing with respect to the external side wall of the main body selectable.

In some embodiments, there are multiple sliding tracks disposed on the external side wall of the main body for selectively installing the first lateral wing to select the tilt angles.

In some embodiments, the lighting apparatus may have a rotating axial structure for connecting the first lateral wing to the main body for the first lateral wing to rotate with respect to the main body to change the tilt angle.

In some embodiments, a connection portion of the main body to connect the light passing cover has a first width, the light passing cover has an enlarged cross section with a second width, the second width is larger than the first width.

In some embodiments, the elongated light source is disposed at a bottom of the main body and the main body has an air passing cavity above the elongated light source, and there is an air hole on the main body for heat dissipation.

In some embodiments, the lighting apparatus may have a first cap cover and a second cap cover disposed on two ends of the main housing.

In some embodiments, the first cap cover is attached with a plug line connecting to a power source, and the second cap cover has a socket for connecting to another lighting apparatus.

In some embodiments, an attached device is attached to the socket of the second cap for receiving a working power to operate the attached device.

In some embodiments, the attached device receives a wireless external command from an external device to control the elongated light source.

In some embodiments, a driver is disposed in the main body of the main housing for converting an indoor power to a driving current supplied to the elongated light source.

In some embodiments, the lateral wing emits a second light.

In some embodiments, there is a second light source disposed on the first lateral wing.

In some embodiments, there is a connector for providing electricity to the second light source on the first lateral wing.

In some embodiments, there is a third light source emitting light to a light guide on the first lateral wing to emit light from the first lateral wing.

DETAILED DESCRIPTION

Figure 16:
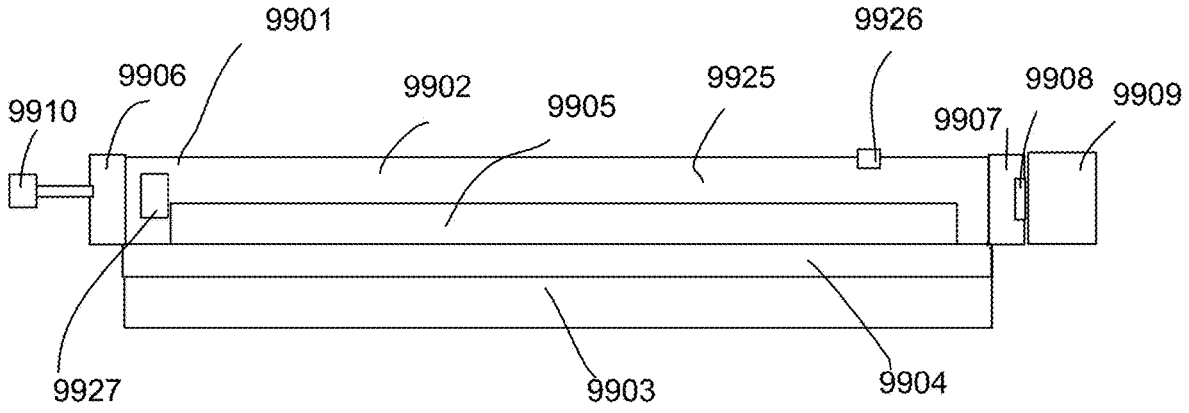
FIG. 16 provides a diagram showing components in examples.
Figure 17:
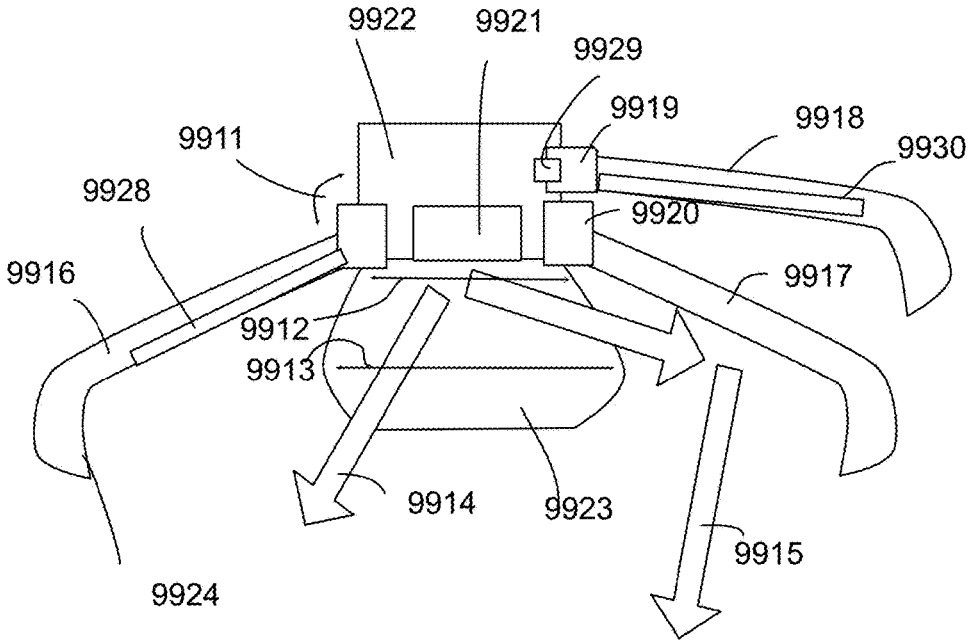
FIG. 17 provides a diagram showing components in examples.

Please refer to FIG. 16 and FIG. 17. a lighting apparatus includes an elongated light source 9905, a main housing 9901 and a first lateral wing 9904.

The main housing 9901 has a main body 9902 and a light passing cover 9903. The elongated light source 9905 is attached to the main body 9902.

The lighting apparatus also has two cap covers 9907 and 9908 on two opposite ends of the main housing. There may be a plug 9910 for receiving an external power source at one cap cover 9907. There may be a socket 9908 for providing power to another lighting device or an attached device 9909. The attached device 9909 may be a sensor for detecting environment light so as to provide information to a driver that controls the elongated light source 9905. The attached device 9909 may receive an external command from an external device like a mobile phone for providing a second control method to the lighting apparatus. The attached device 9909 may contain a battery and related circuit for providing power to the elongated light source. Other augmented functions may be added via the attached device 9909.

Please refer to FIG. 17. In FIG. 17. The main housing has a main body 9922 and a light passing cover 9923. There are two lateral wings 9916 and 9917 attached via connectors 9920 to two external side walls of the main body 9922. There is a tilt angle 9911 of the lateral wing 9916 with respect to the main body 9922. In some embodiment, the connector 9920 is a rotating structure so that the lateral wing may be rotated with respect to the main body 9922 for changing the title angle of the lateral wing 9916, 9917 with respect to the main body 9922.

There may be more than one connector for connecting the lateral wing to the main body 9922. For example, the connector 9919, in addition to the connector 9920 may be disposed on the main body 9922 so as to change the place for installing the lateral wing 9917 to another place of a lateral wing 9918.

There may be an inward curve 9924 at end of the lateral wing 9916 for capture more light to desired directions.

There may be an air passing cavity 9925 in the main body 9902 with even an air hole 9926 for heat dissipation.

There may be a driver 9927 for converting an external power to a driving current.

The connectors may be in other forms as explained in more details below.

The two lateral wings on two sides of the main body may have different tilt angles so as to meet requirements of certain environment settings. For example, when the lighting apparatus is placed near a wall area, the lateral wing closer to the wall is configured with a larger tilt angle to reflect more light to a central area of the lighting apparatus. If necessary, e.g. to provide light on a painting on a wall, the lateral wing may even be detached and removed from the main body completely to allow more light on the painting.

Light emitted from a light source 9921 passes through the light 9914 passing cover 9923. A portion of the light 9915 is reflected by the lateral wing 9917.

There is a first width 9912 for a connection portion 9912 of the main body 9922 to the light passing cover 9923. There is a second width 9913 for an enlarged portion of the light passing cover 9923. The first width 9912 is smaller than the second width 9913.

There may be a light source 9928 disposed on the lateral wing 9916 receiving power from a driver 9927 and the light source 9928 emits an additional light.

In some embodiments, a light guide 9930 may be disposed on the lateral wing 9918 for receiving and guiding light from an addition light source 9929 on the main body 9922.

For example, the main housing is a tubular housing with a guiding track for inserting a light source plate mounted with LED modules to slide in the guiding track. A light passing cover may be made together with the main body with a plastic material. The main body may have a first color while the light passing cover has a second color. Specifically, the main body may have the color which light does not pass through. Therefore, people would not see the components concealed in the main body. On the other hand, the light passing cover may have a second color, e.g. to allow light passing through. The light passing cover may have a diffusion layer so that light passing through the light passing cover is diffused to be softened. In some other embodiments, the light passing cover may contain or integrated with lens structure for guiding light of the elongated light source to form a light beam or to change a main light path of the elongated light source.

The first lateral wing is detachably attached to an external side wall of the main body. A portion of the light passing through the light passing cover further being reflected by an inner surface of the lateral wing. For example, the inner surface of the first lateral wing may be disposed with white color or any reflective layer suitable for reflecting light emitted on the inner surface of the first lateral wing.

In some embodiments, the lighting apparatus may have a second lateral wing. The first lateral wing and the second lateral wing are disposed on opposite sides of the main body.

In some embodiments, the first wing has a first tilt angle with respect to the main body and the second wing has a second tilt angle with respect to the main body. The first tilt angle and the second tilt angle are different.

In some embodiments, the first lateral wing is detachable and taken away from the main body.

In some embodiments, a first end of the first lateral wing is connected to the main body and a second end of the first lateral wing is connected to another lighting apparatus.

In some embodiments, a first end of the first lateral is connected to the main body and a second end opposite to the first end has an inwardly curve.

In some embodiments, there are multiple tilt angles of the first lateral wing with respect to the external side wall of the main body selectable.

In some embodiments, there are multiple sliding tracks disposed on the external side wall of the main body for selectively installing the first lateral wing to select the tilt angles.

In some embodiments, the lighting apparatus may have a rotating axial structure for connecting the first lateral wing to the main body for the first lateral wing to rotate with respect to the main body to change the tilt angle.

In some embodiments, a connection portion of the main body to connect the light passing cover has a first width, the light passing cover has an enlarged cross section with a second width, the second width is larger than the first width.

In some embodiments, the elongated light source is disposed at a bottom of the main body and the main body has an air passing cavity above the elongated light source, and there is an air hole on the main body for heat dissipation.

In some embodiments, the lighting apparatus may have a first cap cover and a second cap cover disposed on two ends of the main housing.

In some embodiments, the first cap cover is attached with a plug line connecting to a power source, and the second cap cover has a socket for connecting to another lighting apparatus.

In some embodiments, an attached device is attached to the socket of the second cap for receiving a working power to operate the attached device.

In some embodiments, the attached device receives a wireless external command from an external device to control the elongated light source.

In some embodiments, a driver is disposed in the main body of the main housing for converting an indoor power to a driving current supplied to the elongated light source.

In some embodiments, the lateral wing emits a second light.

In some embodiments, there is a second light source disposed on the first lateral wing.

In some embodiments, there is a connector for providing electricity to the second light source on the first lateral wing.

In some embodiments, there is a third light source emitting light to a light guide on the first lateral wing to emit light from the first lateral wing.

Please refer to FIG. 1 to FIG. 5, the linear lighting apparatus includes a main housing 10, a light source module 20, a driver 30, a lateral wing 40 and two cap cover 50. The light source module 20 is installed in the main housing 10. The driver 30 and the light source module 20 is connected electronically, in order to drive the light source module 20 to work. The lateral wing 40 is detachably installed on the external side wall of the main housing 10 and is used to adjust the output light angle of the light source module 20. When the lateral wing 40 is installed, it may achieve a small light angle output. When the lateral wing 40 is removed, it may achieve a wider angle light output. Thus, the output light angle of the light source module 20 may be adjusted through the detachable structure of the lateral wing 40. The two cap cover 50 are installed separately on the two ends of the main housing 10, in order to conceal the two ends of the main housing 10. The external side wall of main housing 10 has set up the first guiding track 101 along its axial direction. The lateral wing 40 is installed in the main housing 10, in order to implement the detachable connection between the lateral wing 40 and the main housing 10. The sliding cover 60 is detachably installed on the cap cover 50, which is used to engage with the lateral wing 40, in order to prevent the lateral wing 40 from slipping out of the first guiding track 101. The lateral wing 40 may be detached from the cap cover 50 via the sliding cover 60 when it needs to be removed. At the moment, the lateral wing 40 may slip out of the first guiding track 101, implementing the separation between the lateral wing 40 and the main housing 10. The lateral wing 40 may be slid in the first guiding track 101 when it needs to be installed, and then install a sliding cover 60 on the cap cover 50 in order to fix the lateral wing 40.

In an embodiment, the linear lighting apparatus has a wider scope of application than the technologies nowadays. The first guiding track 101 is installed on the external side wall of main housing 10, along the axial direction of the main housing 10. Cooperating with the detachable installation of the sliding cover 60 which is useful for fixing the lateral wing 40 in order to prevent the lateral wing 40 from slipping out of the first guiding track 101 on the cap cover 50. When the lateral wing 40 is installed, it may achieve a small light angle output. When the lateral wing 40 is removed, it may achieve a wider angle light output. Thus, the adjusting of the output light angle of the light source module 20 may be implemented via the detachable structure of the lateral wing 40, which may meet the demand for different output light angles.

Please refer to FIG. 5 and FIG. 7 to FIG. 11, the linear lighting apparatus has a positioning groove 61 installed on the sliding cover 60 along the axial direction of the main housing 10. The limiter structure 70, which is used to cooperate with the positioning groove 61, is installed on the side wall of the cap cover 50. Via the cooperation between the limiter structure 70 and the positioning groove 61, the sliding cover 60 may be prevented from slipping out of the cap cover 50 in the direction of departure. In an embodiment, the first opening 611 is installed on the positioning groove 61 toward one side of the cap cover 50. The limiter structure includes the guiding bar 71, and the stop plate 72 which is installed on the guiding bar 71 near one side of the main housing 10. The stop plate 72 is a slidable installation in the positioning groove 61, in addition, one side of the guiding bar 71 near the sliding cover 60 reaches into the positioning groove 61 through the first opening 611. The guiding bar 71 is provided to guide the sliding direction when the sliding cover 60 is in touch with the cap cover 50, to avoid displacement. It should be noted that the width on the guiding bar 71 in the radial direction of the main housing 10 is smaller than the width on the first opening 611 in the radial direction of the main housing 10, and the width on the stop plate 72 in the radial direction of the main housing 10 is larger than the width on the first opening 611 in the radial direction of the main housing 10. Therefore, when the sliding cover 60 needs to be installed, the guiding bar 71 may pass through the first opening 611 and reach into the positioning groove 61, to play the role in guiding. When the sliding cover 60 continues to move toward the main housing 10, the stop plate 72 slides in the positioning groove 61 at the moment. Since the width on the stop plate 72 in the radial direction of the main housing 10 is larger than the width on the first opening 611 in the radial direction of the main housing 10, the stop plate 72 may not be released from the first opening 611. Thus, the sliding cover 60 is restricted to move in the opposite direction from cap cover 50.

Figure 8:
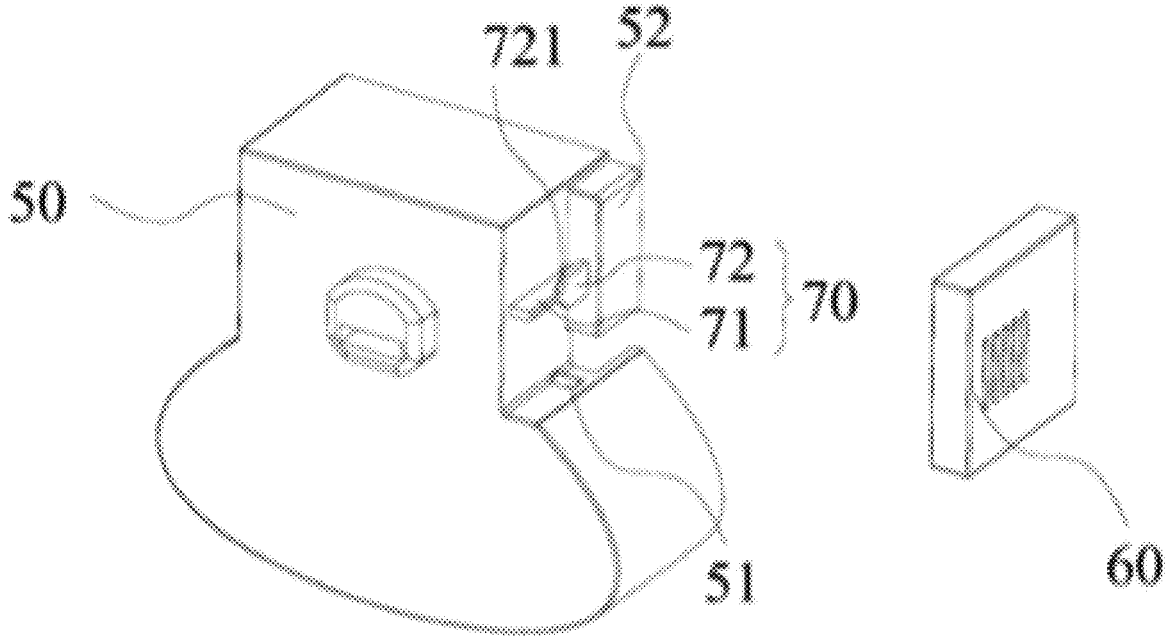
FIG. 8 illustrates a cap cover example.
Figure 9:
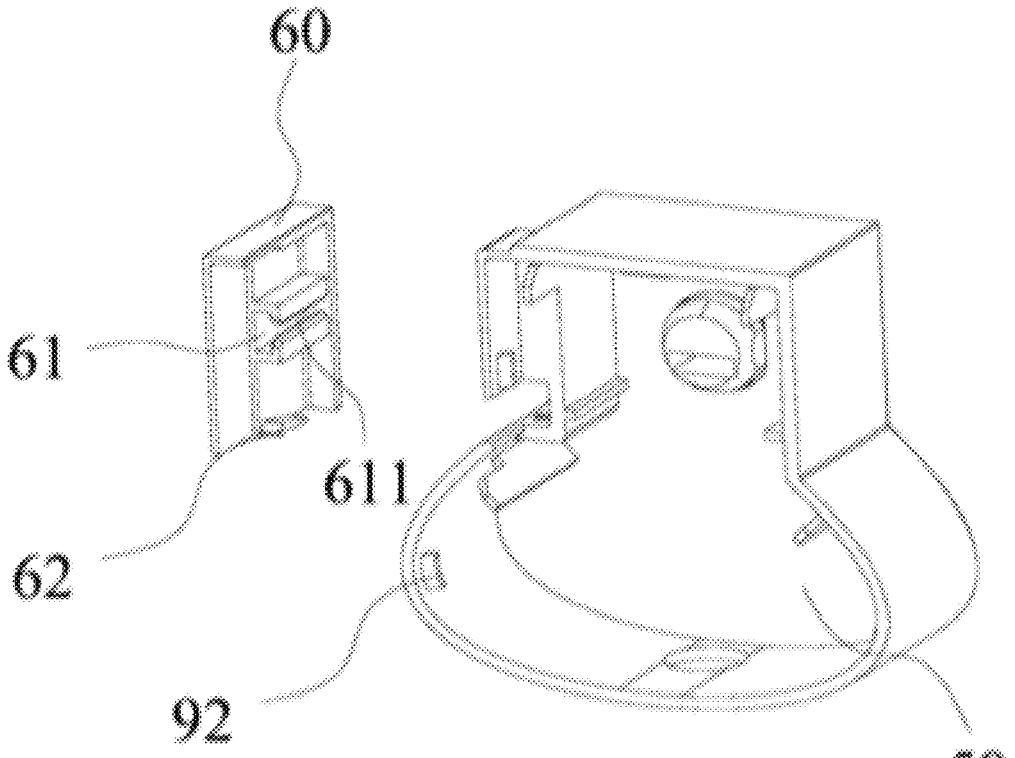
FIG. 9 illustrates details of the cap cover example.

Please refer to FIG. 8 and FIG. 9, the linear lighting apparatus includes a guiding side 721 is installed on one side of stop plate 72, which is far from main housing 10. The width on the guiding side 721 in the radial direction of the main housing 10 gradually increasing along the direction near the main housing 10, to play a good role in guiding function when the sliding cover 60 slides in. The maximum width on the stop plate 72 in the radial direction of the main housing 10 is equal to the maximum width on the positioning groove 61 in the radial direction of the main housing 10. Thereby, it may have an effect of friction after the sliding cover 60 slides into place, preventing the sliding cover 60 from being easily detached from the cap cover 50.

Please refer to FIG. 8 and FIG. 9, the linear lighting apparatus may have a first buckle 62 installed on a sliding cover 60. A second buckle 51, which is used to cooperate with the first buckle 62, is installed on the cap cover 50. The cooperation between the first buckle 62 and the second buckle 51 may prevent the sliding cover 60 from being detached in the opposite direction of the main housing 10.

Please refer to FIG. 8 and FIG. 9, the linear lighting apparatus has a limiting block 52 is installed on the side wall of the cap cover 50. When the sliding cover 60 is fixed on the cap cover 50, the end of the sliding cover 60 near the main housing 10 abuts on the limiting block 52 at the moment. To limit the location, avoiding the sliding cover 60 to continue moving toward the main housing 10.

Please refer to FIG. 10 to FIG. 13, the linear lighting apparatus has a second opening 102 installed on one side of the first guiding track 101 towards the lateral wing 40. The lateral wing 40 includes the installation plate 41 and the lateral plate 42, which is disposed at an angle to the installation plate 41. The installation plate 41 is installed in the first guiding track 101, and the lateral plate 42 reaches out of the first guiding track 101 through the second opening 102, to play the role in limiting the output light angle of the light source module 20. The width on the installation plate 41 in the radial direction of the main housing 10 is larger than the width on the second opening 102 in the radial direction of the main housing 10. Thus, the installation plate 41 may be fixed in the first guiding track 101, avoiding the installation plate 41 being unable to detach from the second opening 102. The width on the lateral plate 42 in the radial direction of the main housing 10 is smaller than the width on the second opening 102 in the radial direction of the main housing 10, so that the lateral plate 42 may reach out of the second opening 102, to adjust the output light angle of the light source module 20.

Figure 1:
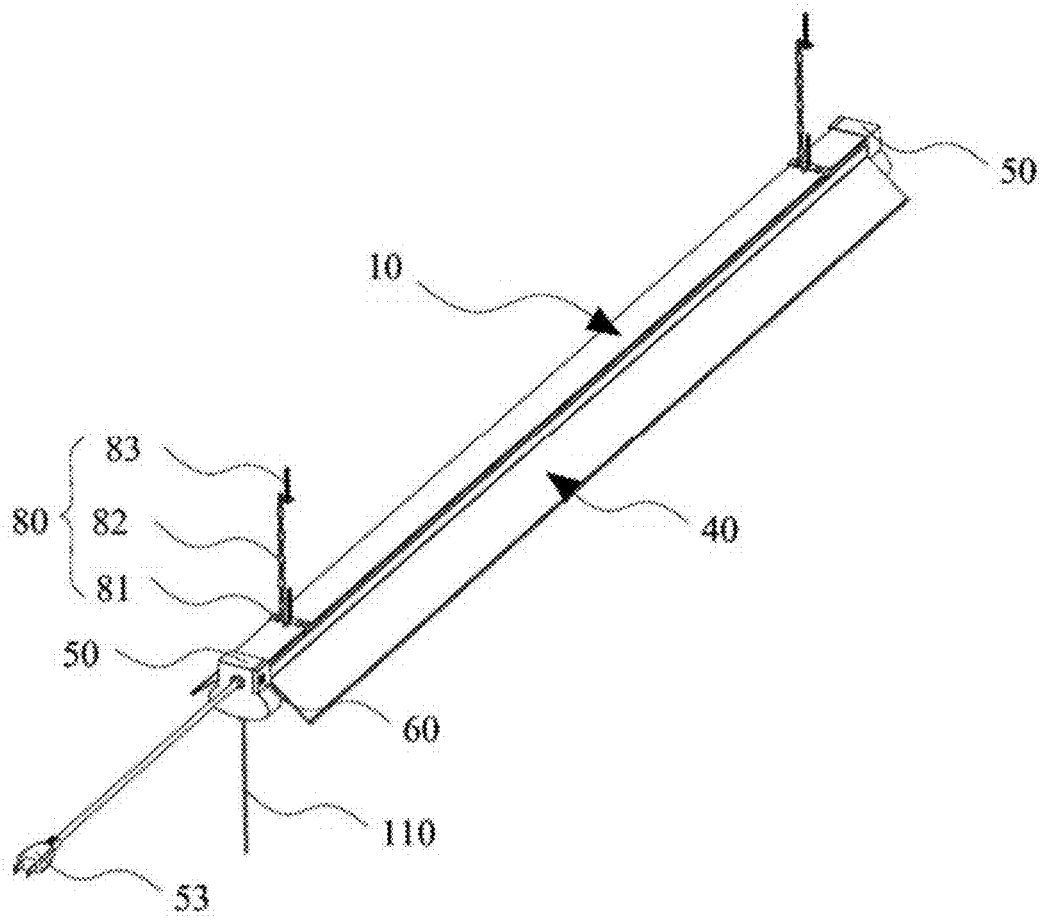
FIG. 1 illustrates a lighting apparatus embodiment.
Figure 2:
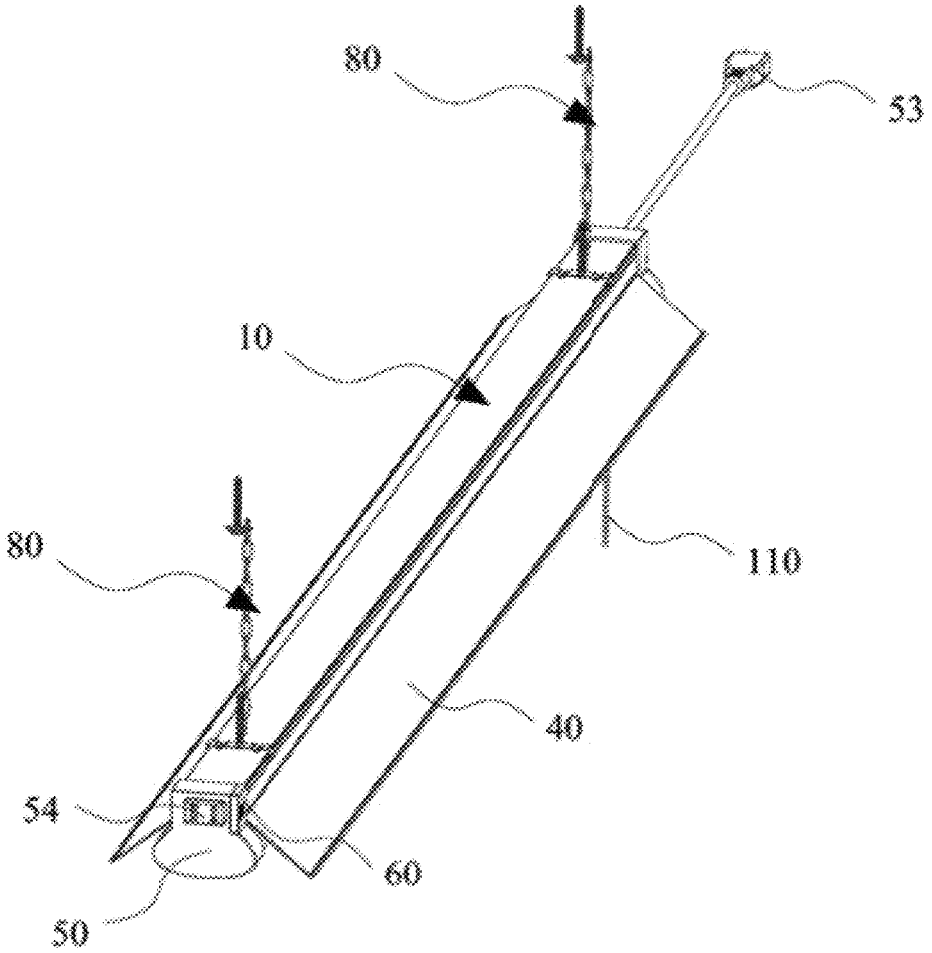
FIG. 2 illustrates another view of the embodiment in FIG. 1.
Figure 3:
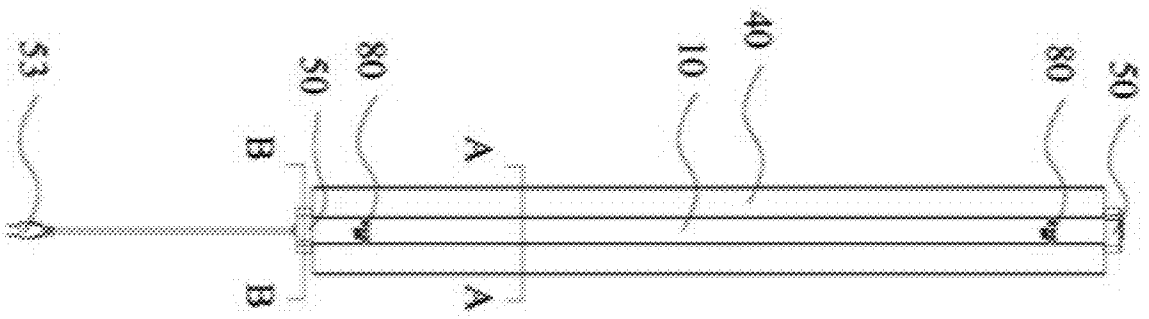
FIG. 3 illustrates another view of the embodiment in FIG. 1.

Please refer to FIG. 1 and FIG. 2, one of a cap cover 50 is provided with a plug 53, which is useful for connecting with indoor electricity power, the other one is provided with the plug 54. The plug 54 may be used to provide the inserting of plug 53 on another linear lighting apparatus, to implement the electrical connection between different linear lighting apparatus, and rapidly assemble different linear lighting apparatus. It is convenient to use and may meet the demands of lighting in different occasions. Please refer to FIG. 4 and FIG. 5, the second guiding track 103 is installed on the inner side wall of the main housing 10. The light source module 20 is installed in the second guiding track 103, to implement the rapid installation and fixation of the light source module 20.

Figure 10:
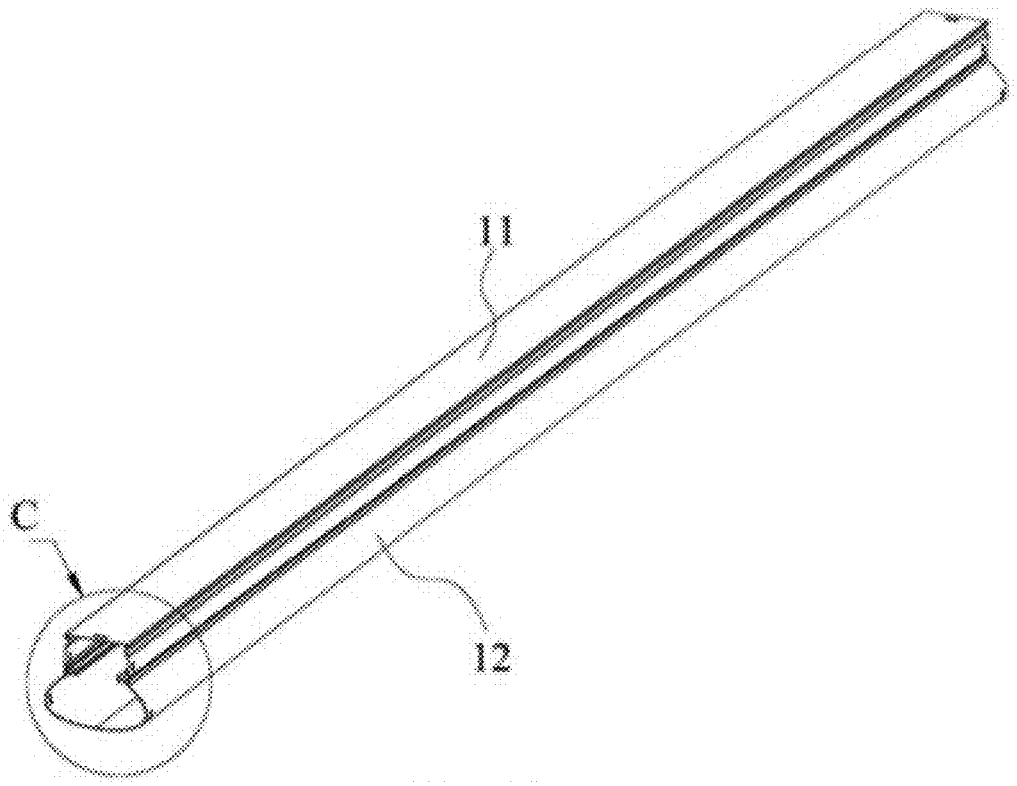
FIG. 10 illustrates components of an embodiment.
Figure 11:
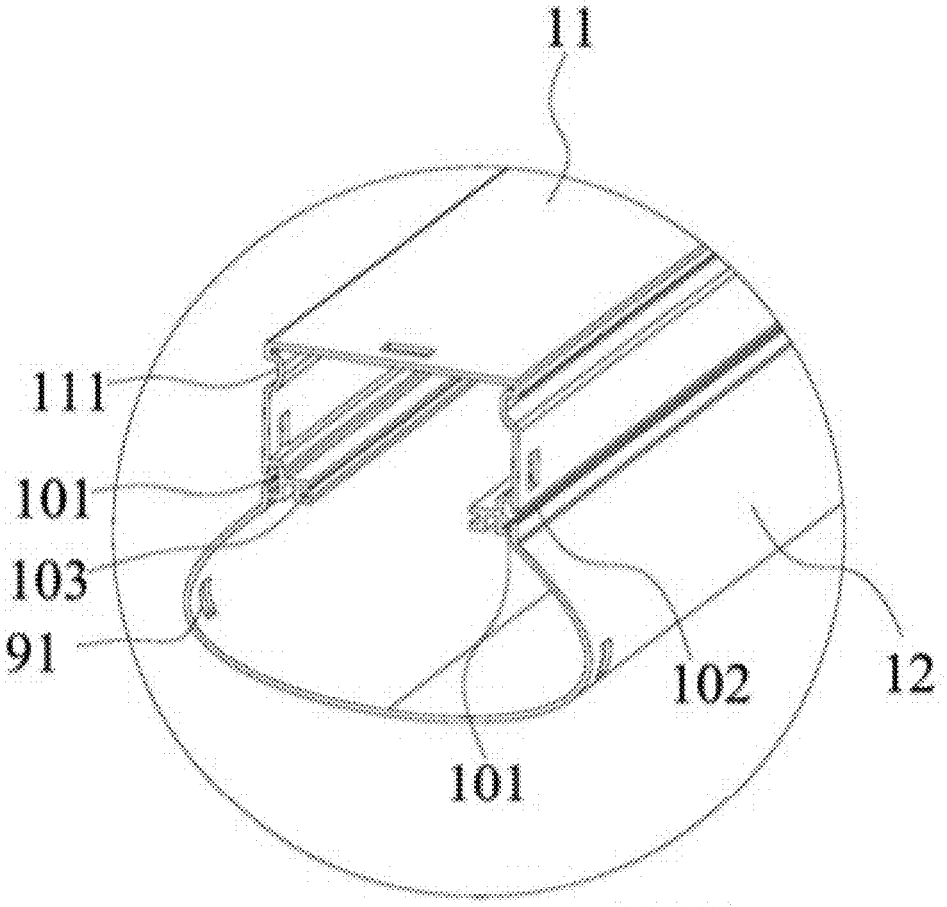
FIG. 11 illustrates an enlarged view of portion of an example.
Figure 12:
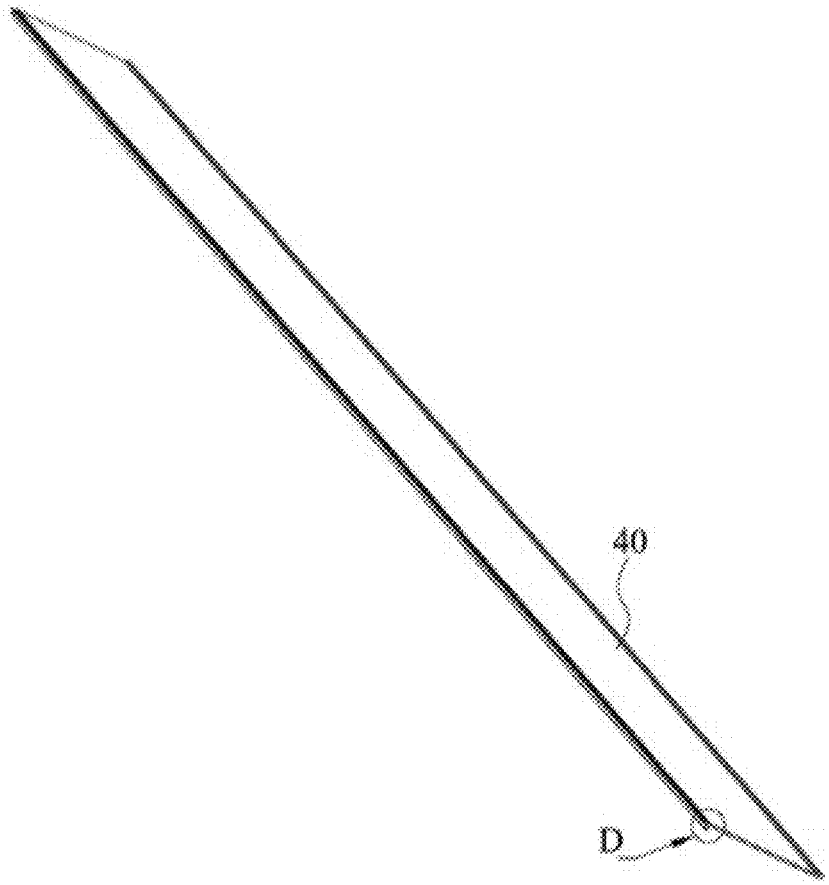
FIG. 12 illustrates another embodiment.
Figure 13:
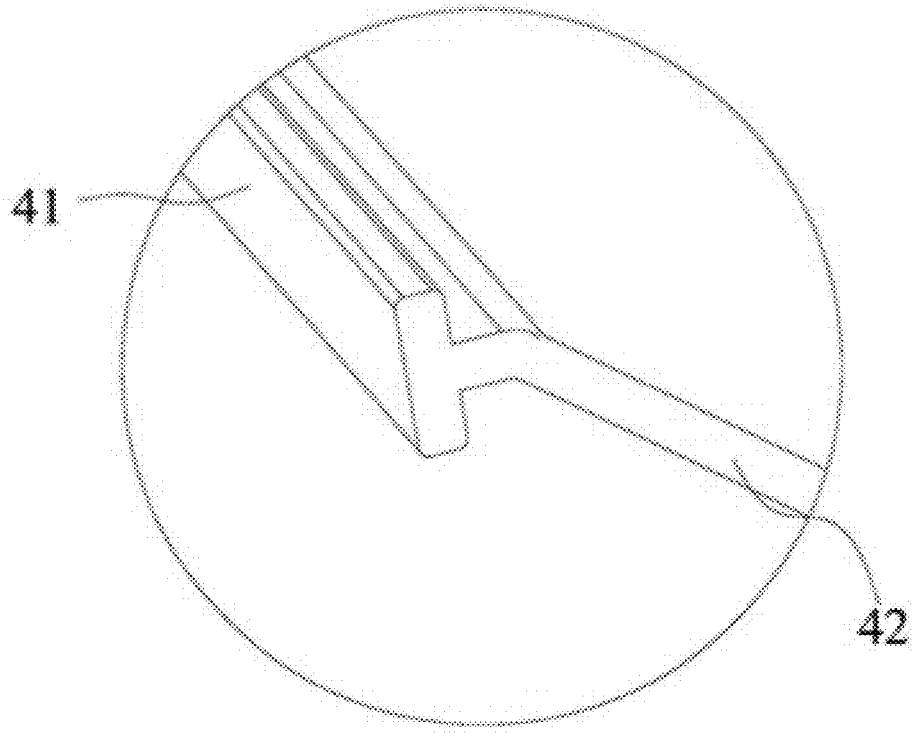
FIG. 13 illustrates an enlarged view of an example.

Please refer to FIG. 10 and FIG. 11, the main housing 10 includes a main body 11 and a lighting passing cover 12, which is two-color extrusion shaping with the main body 11. The main body 11 and the lighting passing cover 12 are encircled to form a hollow structure, which is used to contain a light source module 20, the luminous surface of the light source module 20 faces the lighting passing cover 12. By employing the main housing 10, which is made of two-color extrusion shaping, the phenomenon of the light leakage at the connection between the main body 11 and the lighting passing cover 12 may be effectively avoided. The main body 11 may be made of metal material, and the lighting passing cover 12 may be made of plastic material.

Figure 4:
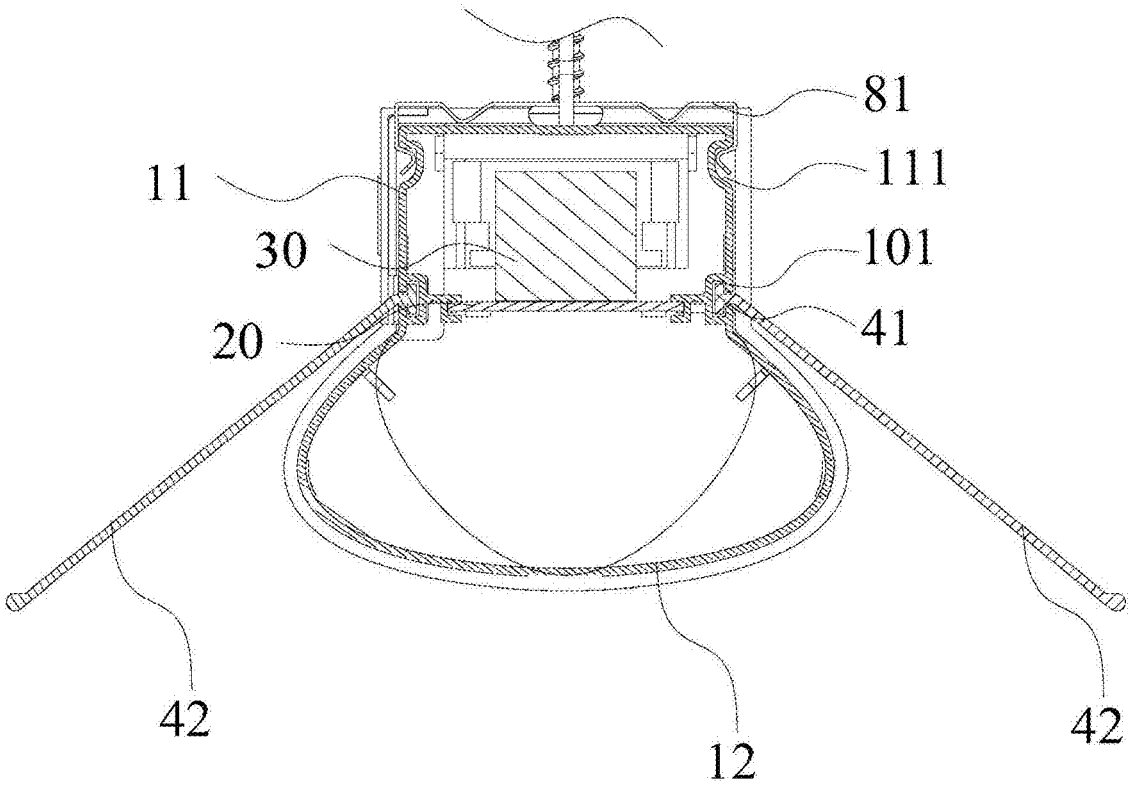
FIG. 4 illustrates a cross section view of the embodiment in FIG. 1.
Figure 5:
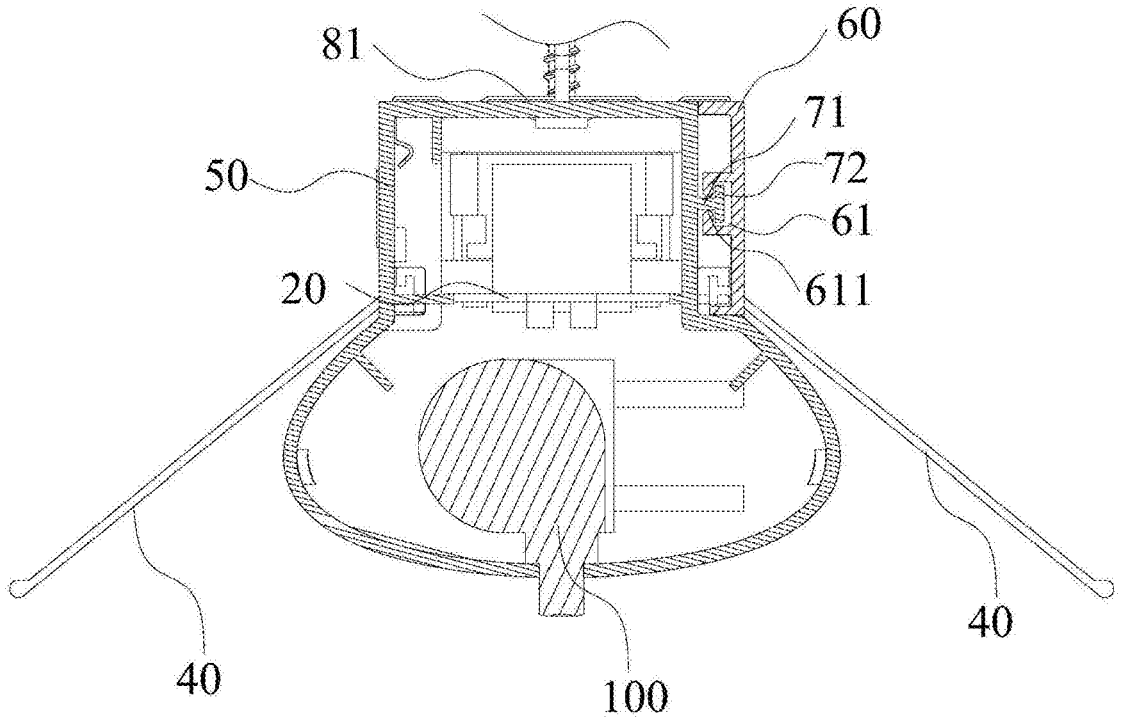
FIG. 5 illustrates another cross section view of the embodiment in FIG. 1.
Figure 6:
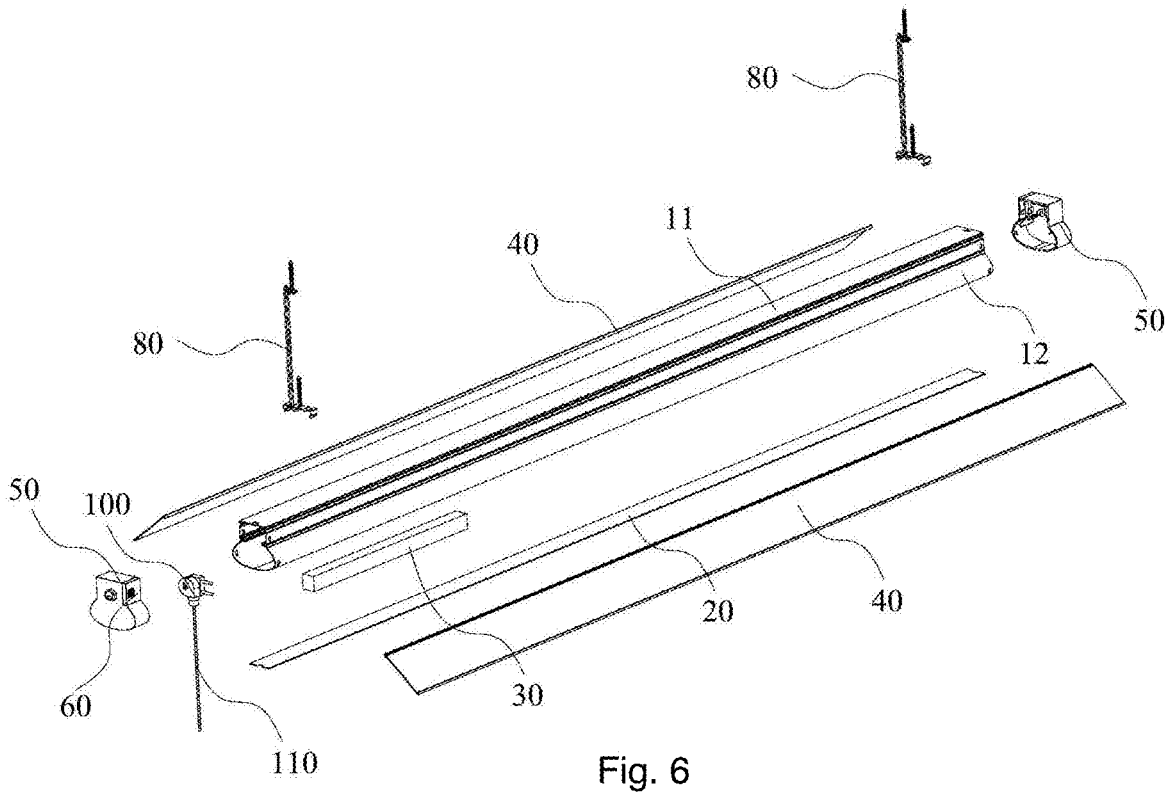
FIG. 6 illustrates an exploded diagram showing components.
Figure 7:
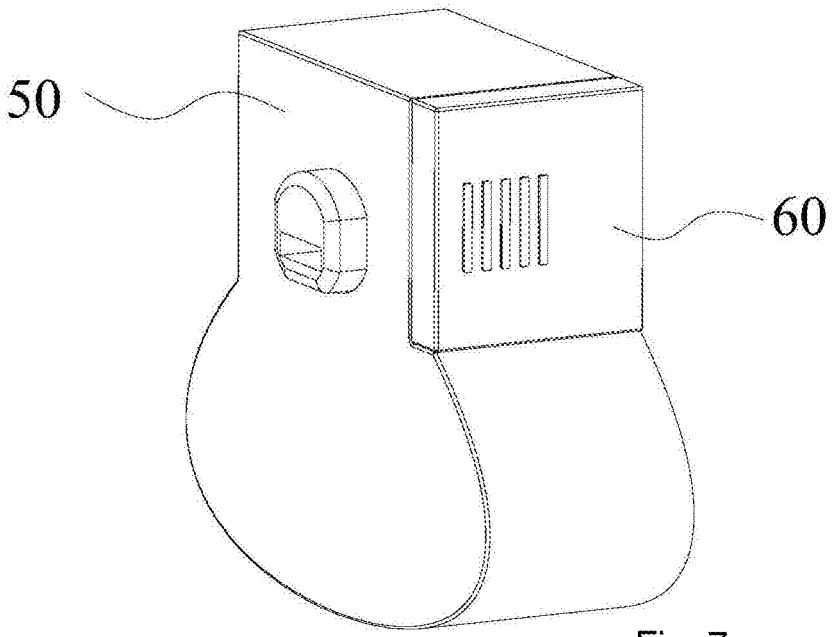
FIG. 7 illustrates a perspective view of a portion of an example.

Please refer to FIG. 4 and FIG. 6, the linear lighting apparatus has a fifth guiding track 111 installed on the external side wall of the two opposite devices of the main body 11. The linear lighting apparatus also includes a hanging unit 80, which is used to install linear lighting apparatus on a mounting surface (such as a ceiling). The hanging unit 80 includes a second elastic clip 81, a hanging chain 82 and a second fastener 83. The two ends of the second elastic clip 81 are separately fixed in the fifth guiding track 111. One end of the hanging chain 82 is connected with the second elastic clip 81, the other one is connected with the second fastener 83. The installation and fixable of linear lighting apparatus may be implemented by the cooperation between the second fastener 83 and the mounting surface. An expansion screw is preferred for the second fastener 83. When the linear lighting apparatus needs to be installed on the mounting surface, the second fastener 83 may be connected and fixed on the mounting surface first, and then the fifth guiding track 111 of the linear lighting apparatus may be cooperated with the second elastic clip 81, so that the linear lighting apparatus may be installed on the mounting surface.

Please refer to FIG. 6, FIG. 10 and FIG. 11, the linear lighting apparatus also includes the clamping module, which is useful for the cap cover 50 to detachably installed on the main housing 10. The cap cover 50 may be rapidly assembled with the main housing 10 by the installation of the clamping module. Specifically, the clamping module includes the block hole 91 and the block 92, which is cooperated with the block hole 91. In an embodiment, the block hole 91 is installed on the main housing 10 and the block 92 is installed on the cap cover 50. It should be noted that the method of installation of the clip and the block hole 91 is not limited to this. For example, in another embodiment, the block hole 91 may also be installed on the cap cover 50 and the block 92 may be installed on the main housing 10.

Please refer to FIG. 1 and FIG. 6, the linear lighting apparatus includes a color temperature switch 100 which can be used to adjust the color temperature of the light source module 20 is installed on one of the cap cover 50. The color temperature switch 100 may switch multiple color temperatures. Specifically, through holes are installed on the cap cover 50. The color temperature switch 100 includes pulling string 110, one end of the pulling string 110 passes through the hole and exposes out of the cap cover 50, so that the color temperature may be conveniently switched.

Figure 14:
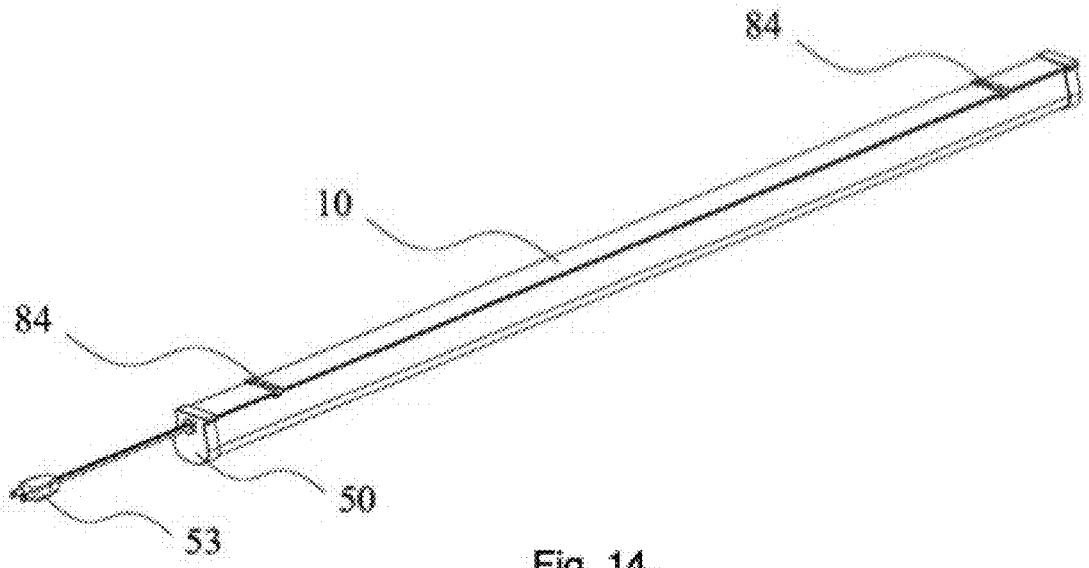
FIG. 14 illustrates an example with connection to other lighting apparatus.
Figure 15:
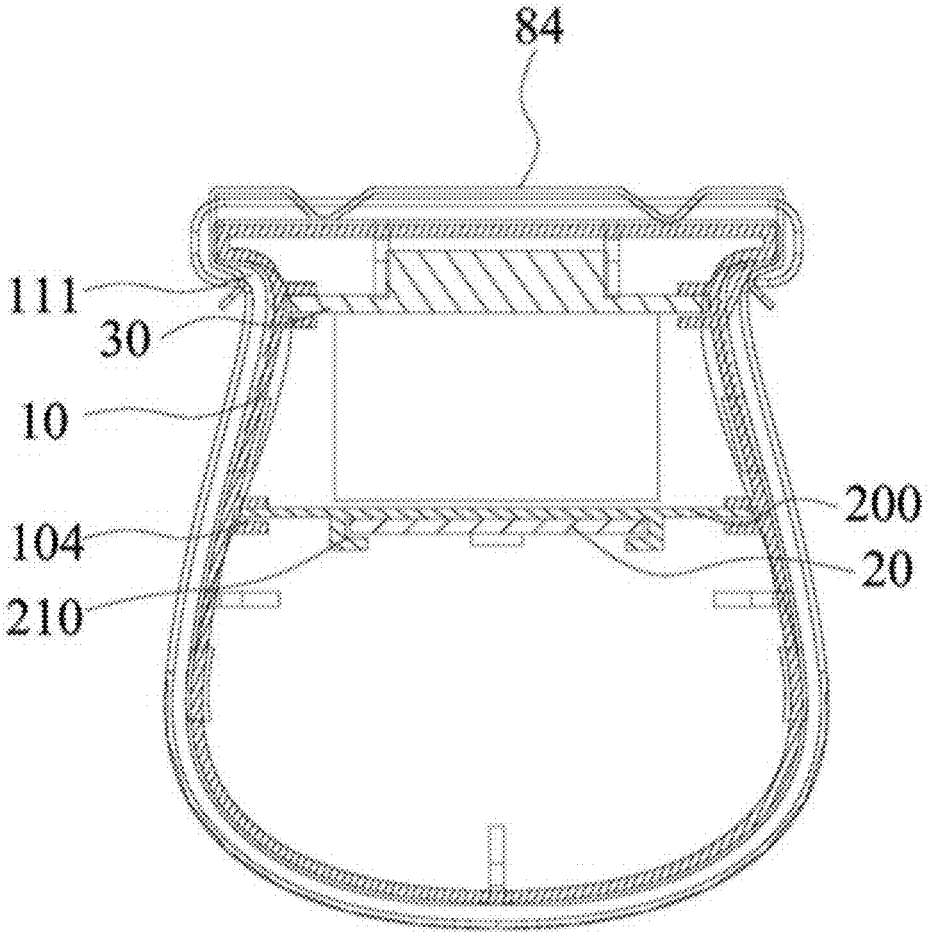
FIG. 15 illustrates another embodiment.

Please refer to FIG. 14 and FIG. 15, the linear lighting apparatus also includes a support plate 200 which is used to support the light source module 20. The third guiding track 104 is installed on the inner side wall of the main housing 10, and the support plate 200 is clamped in the third guiding track 104. The fourth guiding track 210 is installed on the support plate 200 and the fourth guiding track 210 is clamped in the light source module 20, which may also implement the installation of the light source module 20.

Please refer to FIG. 14 and FIG. 15. In the second embodiment, the hanging unit 80 includes the first fastener, the two ends of the first shrapnel 84 are separately clamped in the fifth guiding track 111. The first fastener is used to connected and fixed on the mounting surface. The installation of a linear lighting apparatus may be implemented by the cooperation between the first fastener and the mounting surface. The first fastener is preferred to be an expansion screw. When linear lighting apparatus needs to be installed on a mounting surface, the first fastener may be connected and fixed on the mounting surface first, and then the fifth guiding track 111 of linear lighting apparatus is cooperated with the first shrapnel 84, to install linear lighting apparatus on the mounting surface.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

an elongated light source;

a main housing having a main body and a light passing cover, the elongated light source being attached to the main body, a light of the elongated light source passing through the light passing cover; and a first lateral wing detachably attached to an external side wall of the main body, a portion of the light passing through the light passing cover further being reflected by an inner surface of the lateral wing, wherein the lateral wing emits a second light, wherein there is a third light source emitting light to a light guide on the first lateral wing to emit light from the first lateral wing.

2. The lighting apparatus of claim 1, further comprising a second lateral wing, the first lateral wing and the second lateral wing being disposed on opposite sides of the main body.

3. The lighting apparatus of claim 2, wherein the first wing has a first tilt angle with respect to the main body and the second wing has a second tilt angle with respect to the main body, the first tilt angle and the second tilt angle are different.

4. The lighting apparatus of claim 1, wherein the first lateral wing is detachable and taken away from the main body.

5. The lighting apparatus of claim 1, wherein a first end of the first lateral is connected to the main body and a second end opposite to the first end has an inwardly curve.

6. The lighting apparatus of claim 1, wherein there are multiple tilt angles of the first lateral wing with respect to the external side wall of the main body selectable.

7. The lighting apparatus of claim 6, where there are multiple sliding tracks disposed on the external side wall of the main body for selectively installing the first lateral wing to select the tilt angles.

8. The lighting apparatus of claim 6, further comprising a rotating axial structure for connecting the first lateral wing to the main body for the first lateral wing to rotate with respect to the main body to change the tilt angle.

9. The lighting apparatus of claim 1, wherein a connection portion of the main body to connect the light passing cover has a first width, the light passing cover has an enlarged cross section with a second width, the second width is larger than the first width.

10. The lighting apparatus of claim 1, wherein the elongated light source is disposed at a bottom of the main body and the main body has an air passing cavity above the elongated light source, and there is an air hole on the main body for heat dissipation.

11. The lighting apparatus of claim 1, further comprising a first cap cover and a second cap cover disposed on two ends of the main housing.

12. The lighting apparatus of claim 11, wherein the first cap cover is attached with a plug line connecting to a power source, and the second cap cover has a socket for connecting to another lighting apparatus.

13. The lighting apparatus of claim 12, wherein an attached device is attached to the socket of the second cap for receiving a working power to operate the attached device.

14. The lighting apparatus of claim 13, wherein the attached device receives a wireless external command from an external device to control the elongated light source.

15. The lighting apparatus of claim 11, further comprising a driver disposed in the main body of the main housing for converting an indoor power to a driving current supplied to the elongated light source.

16. The lighting apparatus of claim 1, wherein there is a second light source disposed on the first lateral wing.

17. The lighting apparatus of claim 16, wherein there is a connector for providing electricity to the second light source on the first lateral wing.

* * * * *